US006209737B1

(12) United States Patent
Bliss

(10) Patent No.: US 6,209,737 B1
(45) Date of Patent: Apr. 3, 2001

(54) CUP ASSEMBLY FOR BOTTLE WITH ATTACHMENT MECHANISM

(76) Inventor: Elmer Bliss, 709 Linwood St., Owosso, MI (US) 48867

( * ) Notice: Subject to any disclaimer, the term of this patent is extended or adjusted under 35 U.S.C. 154(b) by 0 days.

(21) Appl. No.: 09/389,951

(22) Filed: Sep. 3, 1999

Related U.S. Application Data

(60) Provisional application No. 60/099,386, filed on Sep. 8, 1998.

(51) Int. Cl.[7] ..... B65D 47/06

(52) U.S. Cl. ..... 215/228; 215/387; 215/DIG. 7; 220/703; 220/378; 222/568; 222/461

(58) Field of Search ..... 215/238, 386, 215/387, DIG. 7, 318, 317; 220/212, 703, 796, 378; 222/568, 460, 461; 141/375, 331, 332, 22, 383, 384

(56) References Cited

U.S. PATENT DOCUMENTS

| | | | | |
|---|---|---|---|---|
| 1,370,665 | * | 3/1921 | Moore | 215/DIG. 7 X |
| 1,382,318 | * | 6/1921 | Pringle | 215/387 |
| 2,019,071 | * | 10/1935 | Carr | 215/DIG. 7 X |
| 2,035,560 | * | 3/1936 | McCarty | 215/DIG. 7 X |
| 2,069,048 | * | 1/1937 | Rehberger | 220/212 X |
| 2,107,309 | * | 2/1938 | Smith | 215/228 |
| 2,304,532 | * | 12/1942 | Boxley | 215/317 X |
| 2,413,438 | * | 12/1946 | Doose | 222/568 |
| 2,543,427 | * | 2/1951 | Warne | 218/228 X |
| 2,582,934 | * | 1/1952 | Parsons | 215/387 |
| 2,778,521 | * | 1/1957 | Cagle | 215/228 |
| 2,827,194 | * | 3/1958 | Matton | 215/228 X |
| 2,881,952 | * | 4/1959 | Dungey | 220/703 X |
| 3,021,977 | * | 2/1962 | Hester | 215/387 X |
| 3,055,363 | * | 9/1962 | Eckhart | 215/386 X |
| 3,115,283 | * | 12/1963 | Lindgren | 222/568 |
| 3,185,341 | * | 5/1965 | Barbour . | |
| 3,381,838 | * | 5/1965 | McClain et al. | 215/DIG. 7 X |
| 3,400,865 | * | 9/1968 | Hester | 222/568 |
| 3,877,499 | * | 4/1975 | Fluster | 141/310 |
| 4,170,994 | * | 10/1979 | Komatsu | 215/386 X |
| 4,217,941 | * | 8/1980 | Catalano | 141/375 X |
| 4,273,166 | * | 6/1981 | Bradley | 141/340 X |
| 4,349,056 | * | 9/1982 | Heino | 215/228 X |
| 4,417,504 | * | 11/1983 | Yamamoto | 220/212 X |
| 4,530,439 | * | 7/1985 | Finnell | 215/DIG. 7 |
| 4,583,668 | * | 4/1986 | Maynard, Jr. | 222/568 |
| 4,717,037 | * | 1/1988 | Van Der Meulen | 220/703 |
| 4,938,395 | * | 7/1990 | Jamieson | 215/387 |
| 5,074,343 | * | 12/1991 | Tyree, Jr. | 141/331 X |
| 5,195,567 | * | 3/1993 | Tyree, Jr. | 141/331 |
| 5,295,981 | * | 3/1994 | Smith et al. | 222/568 |
| 5,474,541 | * | 12/1995 | Ritsly et al. . | |
| 5,632,407 | * | 5/1997 | Christensen | 220/703 X |
| 5,634,714 | * | 6/1997 | Guild | 215/DIG. 7 X |
| 5,685,351 | * | 11/1997 | Kazarian et al. | 215/228 X |
| 5,762,120 | * | 6/1998 | Smith | 141/331 X |
| 5,901,887 | * | 5/1999 | Wark | 222/568 |
| 5,960,698 | * | 9/1999 | Cristca et al. | 151/364 |
| 5,992,481 | * | 11/1999 | Smith | 141/331 X |
| 5,992,662 | * | 11/1999 | Holt et al. | 215/228 X |

FOREIGN PATENT DOCUMENTS

| | | | | |
|---|---|---|---|---|
| 730536 | * | 3/1966 | (CA) | 220/378 |
| 2641874 | * | 4/1919 | (DE) | 220/718 |
| 80872 | * | 4/1919 | (CH) | 220/378 |
| 2657846 | * | 8/1991 | (FR) | 215/DIG. 7 |
| 576029 | * | 3/1946 | (GB) | 215/228 |

* cited by examiner

*Primary Examiner*—Allan N. Shoap
*Assistant Examiner*—Robin A. Hylton
(74) *Attorney, Agent, or Firm*—Bliss McGlynn, P.C.; Daniel H. Bliss

(57) ABSTRACT

A cup assembly for a bottle includes a body having a closed end with an aperture extending therethrough and an open end and a wall tapering from the closed end to the open end. The cup assembly also includes an attachment mechanism to attach the body to an open end of the bottle to allow a user to drink from the open end of the body while attached to the bottle.

6 Claims, 1 Drawing Sheet

CUP ASSEMBLY FOR BOTTLE WITH ATTACHMENT MECHANISM

CROSS-REFERENCE TO RELATED APPLICATION(S)

The present application claims priority from provisional application Ser. No. 60/099,386, filed Sep. 8, 1998.

BACKGROUND OF THE INVENTION

1. Field of the Invention

The present invention relates generally to bottles and, more particularly, to a cup assembly for a bottle.

2. Description of the Related Art

It is known to provide a bottle for containing liquids. Typically, the bottle is generally cylindrical with a closed end and an open end. When liquid is poured through the open end into a cup, the liquid may be spilled. Therefore, there is a need in the art to provide a cup assembly for a bottle.

SUMMARY OF THE INVENTION

It is, therefore, one object of the present invention to provide a cup assembly for a bottle.

It is another object of the present invention to provide a cup assembly which is attached to an open end of a bottle.

It is yet another object of the present invention to provide a cup assembly to be integral with a bottle to prevent spilling of liquid therefrom.

It is still another object of the present invention to provide a cup assembly which is removably attached to a bottle.

To achieve the foregoing object, the present invention is a cup assembly for a bottle. The cup assembly includes a body having a closed end with an aperture extending therethrough and an open end and a wall tapering from the closed end to the open end. The cup assembly includes an attachment mechanism to attach the body to an open end of the bottle to allow a user to drink from the open end of the body while attached to the bottle.

One advantage of the present invention is that a cup assembly is provided for a bottle. Another advantage of the present invention is that the cup assembly is integral with the bottle to prevent spilling of liquid therefrom. Yet another advantage of the present invention is that the cup assembly is removably attached to a bottle to allow a user to drink therefrom while attached to the bottle.

Other objects, features and advantages of the present invention will be readily appreciated as the same becomes better understood after reading the subsequent description when considered in connection with the accompanying drawings.

DESCRIPTION OF THE PREFERRED EMBODIMENT(S)

Figure 1:
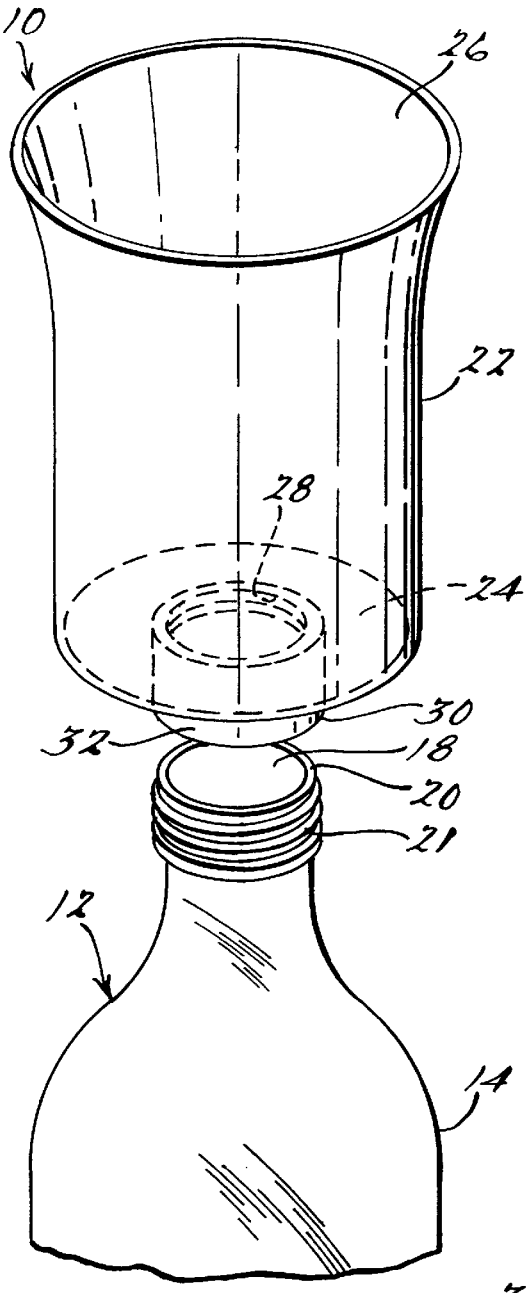
FIG. 1 a perspective exploded view of a cup assembly, according to the present invention, for a bottle.
Figure 2:
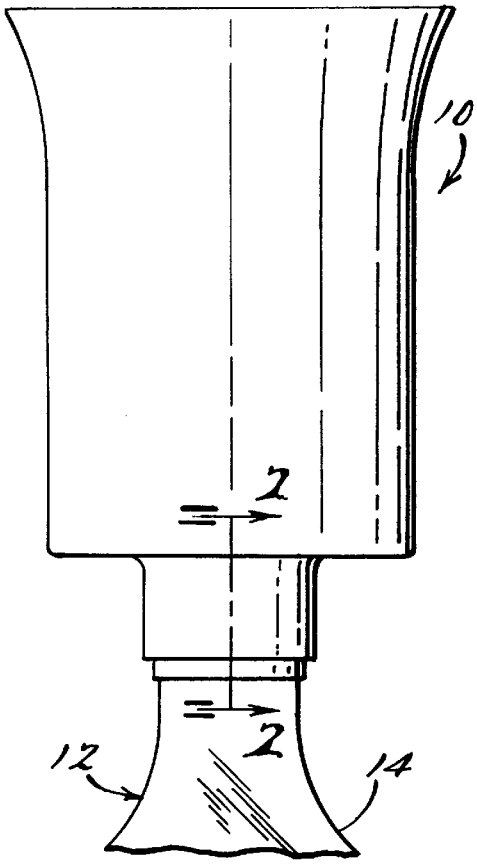
FIG. 2 is an elevational view of the cup assembly and bottle of FIG. 1.
Figure 3:
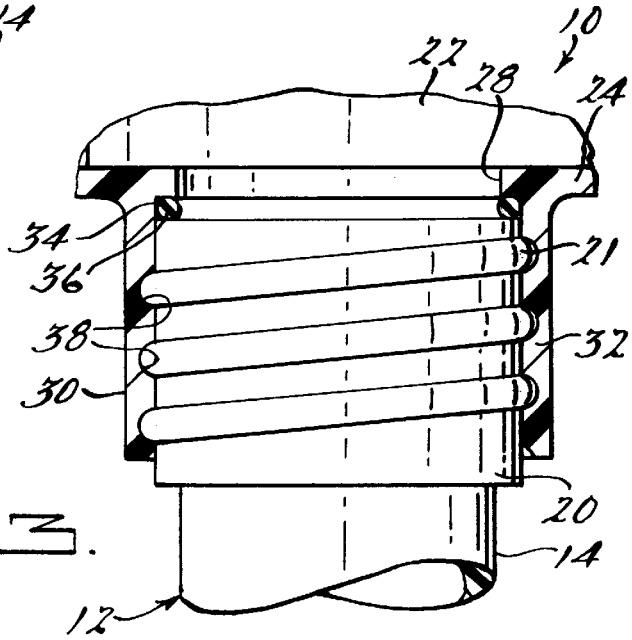
FIG. 3 is a sectional view taken along line 3—3 of FIG. 2.

Referring to the drawings and in particular FIG. 1, one embodiment of a cup assembly 10, according to the present invention, is shown for a bottle, generally indicated at 12. The bottle 12 has a side wall 14 which is generally annular and extends axially. The bottle 12 has a closed end (not shown) at a lower end of the side wall 14 and an open end 18 at an upper end of the side wall 14. The upper end of the side wall 14 also includes a lip 20 disposed about the open end 18 having a plurality of external threads 21. It should be appreciated that the bottle 12 is conventional and known in the art.

The cup assembly 10 includes a body 22 which is annular and extends axially. The body 22 has a closed end 24 at one end and an open end 26 at the other end. The body 22 tapers from the closed end 24 to the open end 26. The closed end 24 has a diameter less than the open end 26. The body 22 is made of a rigid material such as plastic. The closed end has an aperture 28 extending therethrough.

The cup assembly 10 also includes an attachment mechanism 30 to attach the body 22 to the bottle 12. The attachment mechanism 30 may include a wall 32 extending axially and is annular. The wall 32 includes a groove 34 extending annularly and a seal 36 disposed in the groove. The seal 36 is preferably made of an elastomeric material. The wall 32 has a plurality of internal threads 38 for threading the body 22 onto the lip 20. Alternatively, the wall 32 may include a plurality of fingers (not shown) formed by slots (not shown) extending axially therein. It should be appreciated that the fingers deflect radially.

In operation, the cup assembly 10 is attached to the bottle 12 by disposing the attachment mechanism 30 over the open end of the bottle 12. The body 22 is rotated to allow the threads 38 to engage the threads 21 such that the lip 20 is extended through the aperture 28 in the closed end 24. The seal 36 contacts the bottle 12 to prevent liquid from passing therethrough. The user then tips the bottle 12 when the open end 26 of the cup assembly 10 is adjacent the user=s lip to allow liquid to pass from the bottle 12 to the body 22.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A cup assembly for a bottle comprising:

a body having a closed end with an aperture extending therethrough and an open end and an annular first wall tapering from said closed end to said open end; and an annular second wall extending axially from said closed end of said body about said aperture and having a diameter less than said closed end, said second wall including an internal groove disposed below said body and surrounding and adjacent said aperture, a seal disposed in said groove, and a plurality of internal threads for threadably engaging corresponding threads on the bottle to attach said body to an open end of the bottle to allow a user to drink from said open end of said body while attached to the bottle.

2. A cup assembly as set forth in claim 1 wherein said body and second wall are made of a plastic material.

3. A cup assembly as set forth in claim 1 wherein said second wall and said body are a monolithic structure.

4. A cup assembly as set forth in claim 1 wherein said seal is made of an elastomeric material.

5. A cup assembly as set forth in claim 1 wherein said body and said wall are formed as one-piece.

6. A cup and bottle assembly comprising:

a bottle having an open end and a plurality of external threads surrounding said open end; and a cup including a body having a closed end with an aperture extending therethrough and an open end and an annular first wall tapering from said closed end to said open end and an annular second wall extending axially from said closed end of said body about said aperture and having a diameter less than said closed end, said second wall having an annular groove disposed below said body and surrounding and adjacent said aperture, a seal disposed in said groove, and a plurality of internal threads to threadably attach said body to said external threads on said open end of said bottle to allow a user to drink from said open end of said body while attached to said bottle.

* * * * *